US007454353B2

(12) United States Patent
Sperschneider et al.

(10) Patent No.: US 7,454,353 B2
(45) **Date of Patent: *Nov. 18, 2008**

(54) METHOD AND DEVICE FOR THE GENERATION OF A SCALABLE DATA STREAM AND METHOD AND DEVICE FOR DECODING A SCALABLE DATA STREAM

(75) Inventors: Ralph Sperschneider, Erlangen (DE); Bodo Teichmann, Fuerth (DE); Manfred Lutzky, Nuremberg (DE); Bernhard Grill, Lauf (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1019 days.

This patent is subject to a terminal disclaimer.

(21) Appl. No.: 10/450,375

(22) PCT Filed: Jan. 14, 2002

(86) PCT No.: PCT/EP02/00297

§ 371 (c)(1),
(2), (4) Date: Jun. 10, 2003

(87) PCT Pub. No.: WO02/058054

PCT Pub. Date: Jul. 25, 2002

(65) Prior Publication Data

US 2004/0049376 A1 Mar. 11, 2004

(30) Foreign Application Priority Data

Jan. 18, 2001 (DE) ..... 101 02 155

(51) Int. Cl.
*G10L 19/00* (2006.01)
*G10L 21/00* (2006.01)

(52) U.S. Cl. ..... 704/501; 704/500; 704/502; 704/503; 704/504

(58) Field of Classification Search ..... 704/500–504
See application file for complete search history.

(56) References Cited

U.S. PATENT DOCUMENTS 6,029,126 A * 2/2000 Malvar ..... 704/204

(Continued)

FOREIGN PATENT DOCUMENTS

DE 39 12 605 A1 10/1990

(Continued)

OTHER PUBLICATIONS

"MPEG-4 Audio Standardization and Twin VQ" by Takehiro Moriya, Monthly Electronics Magazine vol. 44, No. 3, pp. 81-86, Mar. 1, 1999.

(Continued)

*Primary Examiner*—David R. Hudspeth
*Assistant Examiner*—Eunice Ng
(74) *Attorney, Agent, or Firm*—Michael A. Glenn; Glenn Patent Group

(57) ABSTRACT

In a method of producing a scalable data stream of at least two blocks of output data of a first coder and a block of output data of a second coder, wherein the at least two blocks of output data of the first coder together represent a current section of an input signal in the first coder, and wherein the block of output data of the second coder represents the same current section of the input signal, a determination data block for the current section of the input signal is written. In addition, the block of output data of the second coder, in the direction of transfer from a coding device to a decoding device, is written after the determination data block for the current section of the input signal. In addition, at least one block of output data of the first coder, in the direction of transfer, is written in front of the determination data block of the current section of the input signal, whereupon offset information is written into the scalable data stream indicating that the at least one block of output data of the first coder, in the direction of transfer, is in front of the determination data block. Thus a low-delay transfer and decoding of only the first scaling layer can be obtained.

14 Claims, 6 Drawing Sheets

U.S. PATENT DOCUMENTS

| | | | | |
|---|---|---|---|---|
| 6,092,041 | A | 7/2000 | Pan et al. | |
| 6,108,625 | A * | 8/2000 | Kim | 704/229 |
| 6,115,688 | A * | 9/2000 | Brandenburg et al. | 704/503 |
| 6,182,031 | B1 * | 1/2001 | Kidder et al. | 704/205 |
| 6,263,022 | B1 * | 7/2001 | Chen et al. | 375/240.03 |
| 6,275,531 | B1 * | 8/2001 | Li | 375/240.12 |
| 6,349,284 | B1 * | 2/2002 | Park et al. | 704/500 |
| 6,438,525 | B1 * | 8/2002 | Park | 704/500 |
| 6,446,037 | B1 * | 9/2002 | Fielder et al. | 704/229 |
| 6,502,069 | B1 * | 12/2002 | Grill et al. | 704/219 |
| 2002/0006161 | A1 * | 1/2002 | Van Der Schaar et al. | 375/240.11 |
| 2002/0007273 | A1 * | 1/2002 | Chen | 704/229 |

FOREIGN PATENT DOCUMENTS

| | | | |
|---|---|---|---|
| EP | 0 846 375 | B1 | 8/1996 |
| EP | 0 884 850 | A2 | 12/1998 |
| EP | 0 918 401 | A2 | 5/1999 |
| JP | 2000307661 | A * | 11/2000 |
| WO | WO 97/14229 | | 4/1997 |
| WO | WO 99/33274 | | 7/1999 |

OTHER PUBLICATIONS

"The Throughput Improvement of a Non-RTP Packet to Control RTP Packet Priority" by Ryosuke Fukawa, et al. Technical Report of the Institute of Electronics, Information and Communication Engineers [Information Network], vol. 100, No. 456, IN2000-151, pp. 109-114, Nov. 2000.

"Layered Transmission of Multimedia Data and Control of Packet Order" by Takaaki Komura, et al. Transactions of Information Processing Society of Japan, vol. 41, No. 2, pp. 271-279, Feb. 2000.

"A Study of Diffserv Router Implementation and Performance Evaluation of Elastic Weighted Round Robin Scheduling Algorithm" by Hidetoshi Yokota, et al. Technical Report of the Institute of Electronics, Information and Communication Engineers [Information Network], vol. 100, No. 456, IN2000-152, pp. 115-122, Nov. 2000.

Brandenburg, Karlheinz, "MPEG-4 Natural Audio Coding", Signal Processing: Image Communication 15 (2000) 423-444, Elsevier Science Publishers.

Balakrishnan, M., "Buffer Constraints in a variable-rate packetized video system", 1995 IEEE, Philips Laboratories, pp. 29-32.

ISO/JTC 1/SC 29 WG11 N2503GA, Information Technology—Generic Coding of Audiovisual Objects, Part 3: Audio, Subpart 4: General Audio (GA) Coding AAC/TwinVQ, May 15, 1998.

* cited by examiner

METHOD AND DEVICE FOR THE GENERATION OF A SCALABLE DATA STREAM AND METHOD AND DEVICE FOR DECODING A SCALABLE DATA STREAM

FIELD OF THE INVENTION

The present invention relates to scalable coders (or encoders) and decoders and, in particular, to producing scalable data streams by means of which a low-delay decoding of a lower scaling layer is guaranteed.

BACKGROUND OF THE INVENTION AND PRIOR ART

Scalable coders are shown in EP 0 846 375 B1. In general, scalability is considered as the possibility to decode a subset of a bit stream representing a coded data signal, such as, for example, an audio signal or video signal, into a usable signal. This feature is especially desirable when, for example, a data transmission channel does not offer the required full bandwidth for transferring a complete bit stream. On the other hand, an incomplete decoding on a decoder having a low complexity is possible. In general, different discrete scalability layers are defined in practice.

An example of a scalable coder, as is, for example, defined in subpart 4 (General Audio) of part 3 (Audio) of the MPEG 4 standard (ISO/IEC 14496-3:1999 subpart 4), is shown in FIG. 1. An audio signal s(t) to be coded is fed into the scalable coder on the input side. The scalable coder shown in FIG. 1 comprises a first coder 12 which is an MPEG CELP coder. The second coder 14 is an AAC coder providing a high-quality audio coding and being defined in the MPEG 2 AAC standard (ISO/IEC 13818). The CELP coder 12 provides a first scaling layer via an output line 16 while the AAC coder 14 provides a second scaling layer to a bit stream multiplexer (BitMux) 20 via a second output line 18. On the output side, the bit stream multiplexer then outputs an MPEG 4 LATM bit stream 22 (LATM=Low Overhead MPEG 4 Audio Transport Multiplex). The LATM format is described in section 6.5 of part 3 (Audio) of the first supplement to the MPEG 4 standard (ISO/IEC 14496-3:1999/AMD1:2000).

The scalable audio coder also includes some further elements. First, there are a delay stage 24 in the AAC branch and a delay stage 26 in the CELP branch. By means of the two delay stages an optional delay for the respective branch can be adjusted. A down-sampling stage 28 is downstream of the delay stage 26 of the CELP branch to adapt the sample rate of the input signal s(t) to the sample rate demanded by the CELP coder. An inverse CELP decoder 30 is downstream of the CELP coder 12, the CELP coded/decoded signal being fed to an up-sampling stage 32. The up-sampled signal is then fed to a further delay stage 34, which, in the MPEG 4 standard, is referred to as "Core Coder Delay".

The CoreCoderDelay stage 34 has the following function. If the delay is set to zero, the first coder 14 and the second coder 16 process exactly the same sample values of the audio input signal in a so-called superframe. A superframe can, for example, consist of three AAC frames which together represent a certain number of sample values no. x to no. y of the audio signal. The superframe further includes, for example, 8 CELP blocks, which, in the case of CoreCoderDelay=0, represent the same number of sample values and also the same sample values no. x to no. y.

If, however, a CoreCoderDelay D as a time quantity is set unequal to zero, the three blocks of AAC frames nevertheless represent the same sample values no. x to no. y. The eight blocks of CELP frames, however, represent sample values no. x−Fs D to no. y−Fs D, Fs being the sample frequency of the input signal.

The current time intervals of the input signal in a superframe for the AAC blocks and the CELP blocks can thus either be identical if CoreCoderDelay D=0 or, if D is unequal to zero, be shifted regarding one another by CoreCoderDelay. For the subsequent illustrations, however, CoreCoderDelay equaling zero is assumed for reasons of simplicity without limiting the generality so that the current time interval of the input signal for the first coder and the current time interval for the second coder are identical. In general, however, the only requirement for a superframe is that the AAC block/s or the CELP block/s in a superframe represent the same number of sample values, wherein the sample values themselves do not necessarily have to be identical but can also be shifted regarding one another by CoreCoderDelay.

It is to be noted that depending on the configuration the CELP coder processes a portion of the input signal s(t) faster than the AAC coder 14. In the AAC branch, a block decision stage 26 is downstream of the optional delay stage 24, which, among other things, determines whether short or long windows are to be used for windowing the input signal s(t), wherein short windows are to be selected for strongly transient signals while long windows are preferred for less transient signals, since in the latter the relation between payload data quantity and side information is better than in short windows.

A fixed delay by, for example, ⅝-fold a block is performed by the block decision stage 26 in the present example. In technology, this is referred to as a look ahead function. The block decision stage has to look ahead by a certain time in order to be able to determine whether there are transient signals in the future which have to be coded with short windows. Then, both corresponding signal in the CELP branch and the signal in the AAC branch are fed to means for converting the time representation into a spectral representation, which, in FIG. 1, are referred to by MDCT 36 and 38, respectively (MDCT=Modified Discrete Cosine Transform). The output signals of the MDCT blocks 36, 38 are then fed to a subtracter 40.

At this point, time-matching sample values have to be present, that is the delay in both branches has to be identical.

The following block 44 establishes whether it is more preferable to feed the input signal itself to the AAC coder 14. This is made possible via to the bypass branch 42. If it is, however, established that for example the difference signal at the output of the subtracter 40, as far as the energy is concerned, is smaller than the signal output by the MDCT block 38, not the original signal but the difference signal is taken to be coded by the AAC coder 14 in order to finally form the second scaling layer 18. This comparison can be performed band after band, which is indicated by a frequency-selective switching means (FSS) 44. The detailed functions of the individual elements are well-known in technology and are, for example, described in the MPEG 4 standard and in further MPEG standards.

An essential feature in the MPEG 4 standard and other coder standards is that the transfer of the compressed data signal is to take place via a channel with the constant bit rate. All the high-quality audio codecs operate in a block-based way, that is they process blocks of audio data (order of magnitude 480-1024 samples) to parts of a compressed bit stream which are also referred to as frames. The bit stream format thus has to be built up in such a way that a decoder without a priori information of where a frame starts is able to recognize the beginning of a frame in order to start outputting the decoded audio signal data with the smallest delay possible. Thus each header data block or determination data block of a frame begins with a certain synchronization word which can be searched for in a continue bit stream. Further conventional components in the data stream, apart from the determination data block, are the main data or "payload data" of the individual layers in which the actual compressed audio data is contained.

FIG. 4 shows a bit stream format having a fixed frame length. In this bit stream format, the headers or determination data blocks are inserted into the bit stream in an equidistant way. The side information and the main data belonging to this header follow directly. The length, i. e. number of bits, for the main data is the same in each frame. Such a bit stream format, as is shown in FIG. 4, is, for example, used in MPEG layer 2 or MPEG CELP.

FIG. 5 shows another bit stream format having a fixed frame length and a back pointer. In this bit stream format, the header and the side information are arranged in an equidistant way, as is the case in the format shown in FIG. 4. The beginning of the matching main data, however, only in exceptional circumstances, follows directly after a header. In most cases, the beginning is in one of the previous frames. The number of bits by which the beginning of the main data in the bit stream is shifted are transferred by the side information variable back pointer. The end of this main data can be in this frame or in one of the previous frames. The length of the main data thus is no longer constant. Thus, the number of bits with which a block is coded can be adapted to the features of the signal. At the same time, however, a constant bit rate can be obtained. This technology is referred to as "bit savings bank" or bit reservoir and increases the theoretical delay in the transfer chain. Such a bit stream format is, for example, used in MPEG layer 3 (MP3). The technology of the bit savings bank is also described in the MPEG layer 3 standard.

In general, the bit savings bank is a buffer of bits which can be employed to make more bits available for coding a block of time sample values than are actually allowed by the constant output data rate. The technique of the bit savings bank takes into consideration that some blocks of audio sample values can be coded with fewer bits than is preset by the constant transfer rate so that the bit savings bank fills with these blocks while other blocks of audio sample values have psycho acoustic features which do no allow such a great compression so that, for these blocks, the bits available are not sufficient for a low-interference or no-interference coding. The required additional bits are taken from the bit savings bank so that the bit savings bank is emptied with such blocks.

Such an audio signal, however, as is shown in FIG. 6, could also be transferred by a format having a variable frame length. In the bit stream format "variable frame length", as is illustrated in FIG. 6, the fixed sequence of the bit stream elements header, side information and main data is kept to as in the "fixed frame length". Since the length of the main data is not constant, the bit savings bank technique can be used in this case as well, wherein, however, no back pointers are required, as is the case in FIG. 5. An example of a bit stream format, as is illustrated in FIG. 6, is the transport format ADTS (Audio Data Transport Stream), as is defined in the MPEG 2 AAC standard.

It is to be noted that the previously mentioned coders are no scalable coders but only comprise a single audio coder.

In MPEG 4, the combination of different coders/decoders to a scalable coder/decoder is provided. It is thus possible and practical to combine a CELP voice coder as the first coder with an AAC coder for the further scaling layer/s and to pack it into a bit stream. The meaning of this combination is that there is a possibility to decode either all the scaling layers and thus obtain the best possible audio quality or to decode parts thereof, possibly only the first scaling layer with the corresponding limited audio quality. A reason for this sole decoding of the lowest scaling layer can be that, due to an insufficient bandwidth of the transfer channel, the decoder has only obtained the first scaling layer of the bit stream. Thus, in transferring, the parts of the first scaling layer in the bit stream are preferred compared to the second and further scaling layers, whereby the transfer of the first scaling layer is ensured in capacity bottle necks in the transfer net, while the second scaling layer may get lost completely or partly.

A further reason may be that a decoder wants to obtain the smallest possible codec delay and thus only decodes the first scaling layer. It is to be noted that the codec delay of a CELP codec in general is significantly smaller than the delay of the AAC codec.

In MPEG 4 version 2, the transport format LATM is standardized, which, among other things, can also transfer scalable data streams.

In the following, reference is made to FIG. 2*a*. FIG. 2*a* is a schematic illustration of the sample values of the input signal s(t). The input signal can be divided into different subsequent sections 0, 1, 2 and 3, wherein each section has a certain fixed number of time sample values. Usually the AAC coder 14 (FIG. 1) processes an entire section 0, 1, 2 or 3 to provide a coded data signal for this section. The CELP coder 12 (FIG. 1), however, conventionally processes a smaller amount of time sample values per coding step. Thus, it is exemplarily shown in FIG. 2*b* that the CELP coder or, put generally, the first coder or coder 1 has a block length which is a fourth of the block length of the second coder. It is to be noted that this separation is completely arbitrarily. The block length of the first coder could also be half the size, could, however, also be an eleventh of the block length of the second coder. Thus, the first coder produces four blocks (11, 12, 13, 14) from the section of the input signal, from which the second coder provides a block of data. In FIG. 2*c* a conventional LATM bit stream format is illustrated.

A superframe may have different ratios of number of ACC frames to number of CELP frames, as is illustrated in MPEG 4 by means of a table. Thus, a superframe can, for example, comprise an AAC block and 1 to 12 CELP blocks, 3 AAC blocks and 8 CELP blocks, but depending on the configuration also more AAC blocks than CELP blocks. An LATM frame having an LATM determination data block includes a superframe or even several superframes.

The production of the LATM frame opened by the header 1 is exemplarily described. First, the output data blocks 11, 12, 13, 14 of the CELP coder 12 (FIG. 1) are produced and buffered. In parallel, the output data block of the AAC coder, which, in FIG. 2*c*, is referred to by "1", is produced. When the output data block of the AAC coder is produced, the determination data block (header 1) is written at first. Depending on the convention, the first-produced output data block of the first coder, which, in FIG. 2*c*, is referred to with 11, can be written, that is transferred, directly after the header 1. An equidistant interval of the output data blocks of the first coder is usually selected for a further writing or transferring, respectively, of the bit stream, as is illustrated in FIG. 2*c* (considering the little signaling information required). This means that, after writing or transferring, respectively of block 11, the second output data block 12 of the first coder, then the third output data block 13 of the first coder and finally the fourth output data block 14 of the first coder are written or transferred, respectively, in equidistant intervals. The output data block 1 of the second coder is inserted into the remaining gaps while transmitting. Then an LATM frame is written completely, that is transferred completely.

It is a disadvantage of this concept that the transfer of the data stream from the coder to the decoder can be started with at the earliest when all the data which has to be contained in the header is available. Thus the LATM header 1 can only be written, that is transferred, when the second coder (AAC coder 14 in FIG. 1) has completed its coding of the current section, since the LATM header, among other things, includes length information on the blocks in the superframe. Thus the output data block 11, the output data block 12, the output data block 13 and the output data block 14 of the first coder have to be buffered in the coder for some time until the second coder 14 which is usually slower, because it operates with a higher frame length, has produced the output data. Even if a decoder only wishes to decode the first scaling layer, that is blocks 11, 12, 13 and 14, it has to wait until the second coder has finished processing the currently considered section or block of the input signal, although the decoder is not interested in the second scaling layer at all. This is the case since the encoder writes the blocks of the first coder into the bit stream with a delay.

This feature is especially annoying in real-time operation. When, for example, a telephone conversation between two persons is considered, a CELP voice coder provides a relatively fast low-delay coding. When at both the sender- and receiver-side only a CELP voice coder is provided, a voice communication without undesired delays is possible. If, however, in both the sender and the receiver a scalable coder according to FIG. 1 is provided to be able to transfer, for example, voice and music in a high-quality way, the bit stream format shown in FIG. 2*c* leads to undesirably long delays which render a real time to and from communication almost impossible or so annoying that such a product would not have the slightest chance on the market.

SUMMARY OF THE INVENTION

It is the object of the present invention to provide a method and a device for producing a scalable data stream by which a low-delay decoding of the first scaling layer is possible.

In accordance with a first aspect of the invention, this object is achieved by a method of producing a scalable data stream of at least two blocks of output data of a first coder and at least one block of output data of a second coder, wherein the at least two blocks of output data of the first coder together represent a number of sample values of the input signal for the first coder which form a current section of the input signal for the first coder, and wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is the same, and wherein the current sections for the first and the second coder are identical or shifted compared to each other by a duration, the method comprising the following steps: writing a determination data block for the current section of the input signal for the first or the second coder; writing a block of output data of the second coder, in the direction of transfer from a coding device to a decoding device, after the determination data block; writing at least one block of output data of the first coder, in the direction of transfer, in front of the determination data block; and writing offset information into the scalable data stream, indicating that the at least one block of output data of the first coder, in the direction of transfer, is in front of the determination data block.

In accordance with a second aspect of the invention, this object is achieved by a device for producing a scalable data stream of at least two blocks of output data of a first coder and at least one block of output data of a second coder, wherein the at least two blocks of output data of the first coder together represent a number of sample values of the input signal for the first coder forming a current section of the input signal for the first coder, wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is equal, and wherein the current sections for the first and second coders are identical or shifted regarding each other by a duration, the device comprising: data stream writing means formed to be able to perform the following steps: writing a determination data block for the current section of the input signal for the first or the second coder; writing a block of output data of the second coder, in the direction of transfer from a coding device to a decoding device, after the determination data block; writing at least one block of output data of the first coder, in the direction of transfer, in front of the determination data block; and writing offset information in the scalable data stream indicating that the at least one block of output data of the first coder, in the direction of transfer, is in front of the determination data block.

It is a further object of the present invention to provide a method and a device for low-delay decoding a scalable data stream.

In accordance with a third aspect of the invention, this object is achieved by a method of decoding a scalable data stream of at least two blocks of output data of a first coder and at least one block of output data of a second coder, wherein the at least two blocks of output data of the first coder together represent a number of sample values of the input signal for the first coder forming a current section of the input signal for the first coder, wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is equal, and wherein the current sections for the first and second coders are identical or shifted regarding each other by a duration, wherein the scalable data stream further comprises a determination data block for the current section of the first coder or the second coder, a block of output data of the second coder after the determination data block, at least one block of output data of the first coder in front of the determination data block and offset information indicating that the at least one block of output data of the first coder, in the direction of transfer from a coding device to a decoding device, is in front of the determination data block, the method comprising the following steps: reading the at least one block of output data of the first coder; reading the output data of the second coder; reading the offset information; determining that the at least one block of output data of the first coder belongs to the output data of the second coder although the at least one block is in front of the determination data block in the data stream; and decoding the output data of the second coder and the output data of the first coder to obtain a decoded signal.

In accordance with a fourth aspect of the invention, this object is achieved by a device for decoding a scalable data stream of at least two blocks of output data of a first coder and at least one block of output data of a second coder, wherein the at least two blocks of output data of the first coder together represent a number of sample values of the input signal for the first coder forming a current section of the input signal for the first coder, wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is equal, wherein the current sections for the first and second coders are identical or shifted, regarding each other, by a duration, wherein the scalable data stream further comprises a determination data block for the current section of the first coder or the second coder, a block of output data of the second coder after the determination data block, at least one block of output data of the first coder in front of the determination data block and offset information indicating that the at least one block of output data of the first coder, in the direction of transfer from a coding device to a decoding device, is in front of the determination data block, the device comprising: data stream demultiplexing means formed in order to be able to perform the following steps: reading the at least one block of output data of the first coder; reading the output data of the second coder; reading the offset information; determining that the at least one block of output data of the first coder belongs to the output data of the second coder although the at least one block is in front of the determination data block in the data stream; and means for decoding the output data of the second coder and the output data of the first coder to obtain a decoded signal.

The present invention is based on the recognition that the convention has to be dispensed with that a frame of the data or bit stream initiated by a determination data block includes both the output data blocks of the first coder for a current time interval and the output data block of the second coder for the current time interval of the input signal.

Instead, according to the present invention, at least an output data block of the first coder is written in a former, that is previous, frame so that a frame initiated by a determination data block comprises at least one output data block of the first coder for a later time interval of the input data. In scalable coders with a first coder providing more output data blocks for a time interval of the input signal than the second coder, the first coder will always have completed first, irrespective of whether it functions a little faster or slower than the second coder, since, in the case of two output data blocks of the first coder, it only has to process half of the time sample values for an output data block of the second coder.

In order to enable a low-delay transfer for the case that only the lowest first scaling layer is of interest for the decoder, the decoder obtains the corresponding output data block of the first coder earlier than it is the case in the prior art. In order for the decoder to produce a high-quality audio signal, in the case that it wants to decode both scaling layers, and perhaps even more than two scaling layers together, offset information is entered for example at some place into the determination data block or generally into the scalable data stream in order for the decoder to establish clearly and doubtlessly which output data blocks of the first coder belong to which output data blocks of the second coder, that is refer to the same time interval of the original input signal.

If a superframe built of a determination data block and data blocks of the first coder and data blocks of the second coder, for example, comprises two blocks of the first coder and three blocks of the second coder, a delay advantage for the first coder is, according to the invention, already obtained when the first block of the first coder is transferred or written, respectively, before writing the LATM header. Even in ratios of the number of output data blocks of the second coder and the number of output data blocks of the first coder larger than one, an inventive advantage is thus already obtained as long as a superframe comprises more than one block, that is at least two blocks, of output data of the first coder.

In a preferred embodiment of the present invention the bit stream is written in such a way that the output data blocks of the first coder are directly written into the bit stream when they are output by the coder and immediately transferred in a real-time operation, irrespective of how long it takes the second coder to complete. With this it is ensured that the delay in transferring the first scaling layer is minimal and really only determined by the interior coder delay of the first coder in the scalable coder and the interior decoder delay of the first decoder in the scalable decoder. If the scalable decoder, however, wants to perform a decoding of the corresponding time interval of the input data with full audio quality, that is with all the scaling layers, it has to buffer the output data blocks of the first coder in the data stream received until offset information arrive in the scalable data stream, in order for scalable decoder to establish how many output data blocks of the first coder are present in a frame which actually do not belong to this frame but belong to the next frame in order to be able to associate the correct output data blocks of the first coder to an output data block of the second coder.

According to a further preferred embodiment of the present invention, the output data blocks of the first coder have a constant length and are written into the bit stream in an equidistant way so that two things can be obtained by this. First, position and length of the output data blocks of the first coder do not especially have to be signaled but can be preset in the decoder. Second, writing the output data blocks of the first coder into the bit stream without a delay is possible if the process time for coding sample values, irrespective of the signal features, is always the same, as is for example the case in a CELP voice coder operating on a time domain basis. The output data block of the second coder is then simply inserted into the gaps. It is to be noted that for a complete writing of the bit stream according to the present invention there are always output data of the second coder since output data blocks of the first coder are written into a frame which is actually provided for the previous time interval which the second coder has already completed coding and the data of which is in a buffer in order to be entered between the output data blocks of the first coder for the current time interval of the scalable data stream.

The inventive scalable data stream is also useful for real-time applications, but can also be employed for non-real-time applications.

A further advantage of the present invention is that the inventive concept for a producing a scalable data stream is compatible with the LATM format preset by MPEG 4, wherein, for example, the offset information is transferred within the LATM header only as additional side information. For signaling the offset only very few bits are required. If 5 bits are, for example, provided for the offset information, an offset of up to 31 output data blocks of the first coder can be signaled without a great number of bits.

BRIEF DESCRIPTION OF THE DRAWINGS

Preferred embodiments of the present invention will be detailed subsequently referring to the enclosed drawings in which.

DETAILED DESCRIPTION OF PREFERRED EMBODIMENTS

Figure 2A:
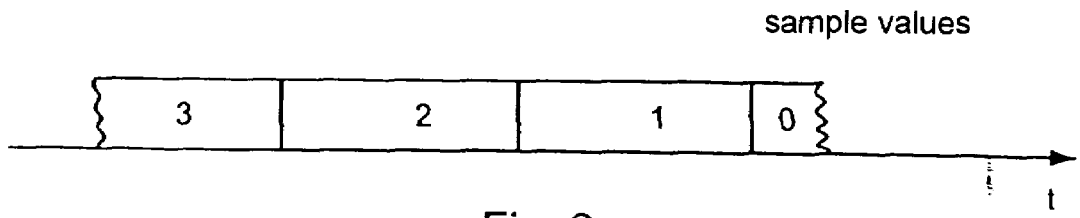
FIG. 2*a* is a schematic illustration of an input signal divided into subsequent time intervals.
Figure 2B:
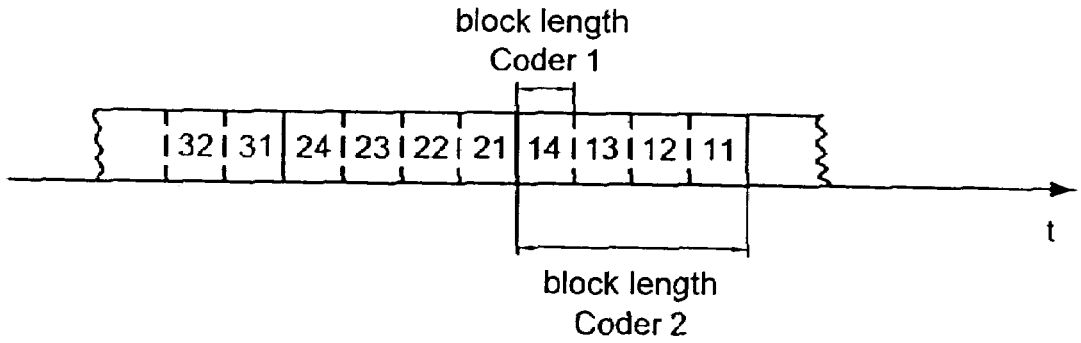
FIG. 2*b* is a schematic illustration of an input signal which is divided into subsequent time intervals, the ratio of the block length of the first coder and the block length of the second coder being illustrated.

In the following FIG. 2*d* will be referred to in comparison to FIG. 2*c* in order to explain the inventive bit stream. Like in FIG. 2*c,* the scalable data stream contains subsequent determination data blocks which are referred to as header 1 and header 2. In the preferred embodiment of the present invention, which is embodied according to the MPEG 4 standard, the determination data blocks are LATM headers. Like in the prior art, in the direction of transfer from an encoder to a decoder, which is illustrated in FIG. 2*d* by an arrow 202, after the LATM header 200, there are the parts, indicated in a hatched way from the upper left side to the lower right side, of the output data block of the AAC coder which are entered into remaining gaps between output data blocks of the first coder.

Unlike in the prior art, in the frame starting by the LATM header 200, there are no longer only output data blocks of the first coder which belong to this frame, such as, for example, the output data blocks 13 and 14, but also the output data blocks 21 and 22 of the subsequent section of input data. Put differently, the two output data blocks of the first coder, referred to with 11 and 12, are present in the bit stream, in the direction of transfer(arrow 202), in front of the LATM header 200 in the example shown in FIG. 2*d.* In the example shown in FIG. 2*d,* the offset information 204 points to an two output data blocks offset of the output data blocks of the first coder. When FIG. 2*d* is compared to FIG. 2*c,* it can be seen that the decoder can decode the lowest scaling layer by precisely the time corresponding to this offset earlier than in the case of FIG. 2*c* when the decoder is only interested in the first scaling layer. The offset information which can, for example, be signaled in the form of a "Core Frame Offset" serves to determine the position of the first output data block 11 in the bit stream.

Figure 1:
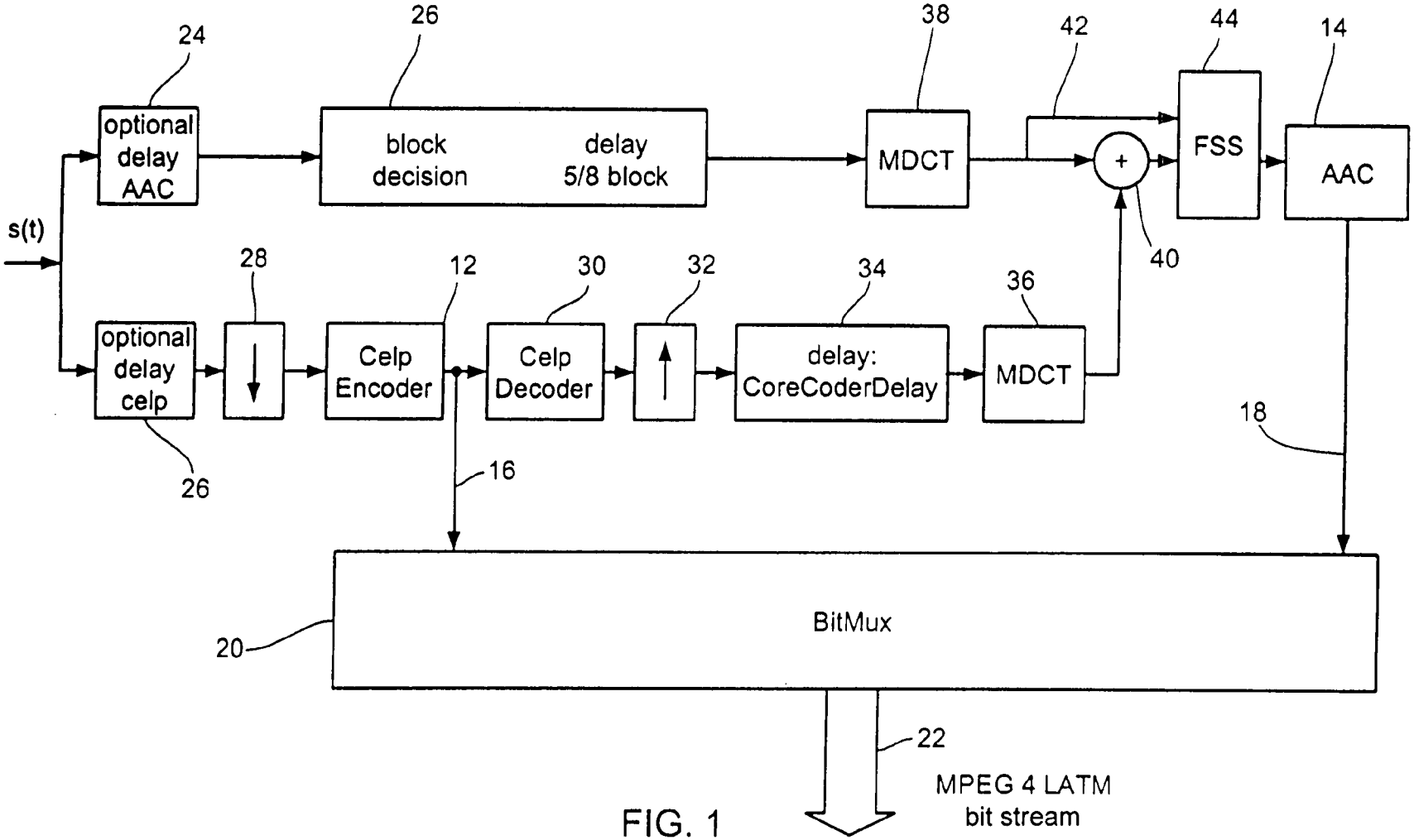
FIG. 1 is a scalable coder according to MPEG 4.
Figure 2C:
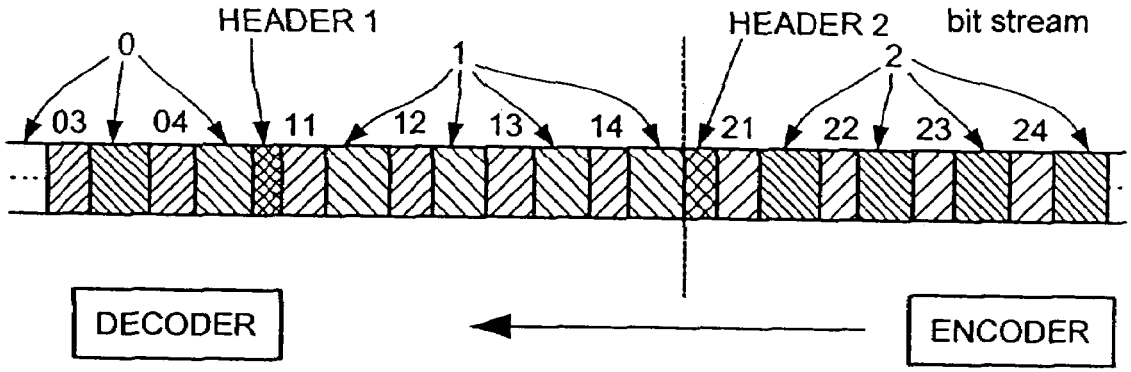
Fig. 2c (Prior Art)
FIG. 2*c* is a schematic illustration of a scalable data stream with a high delay in decoding the first scaling layer.
Figure 2D:
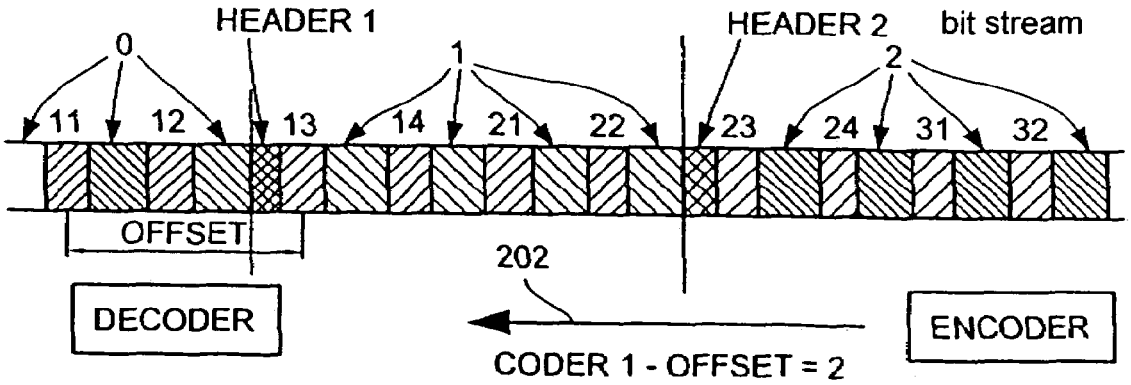
FIG. 2*d* is a schematic illustration of an inventive scalable data stream with a low delay in decoding the first scaling layer.

For the case Core Frame Offset=zero, the bit stream represented in FIG. 2*c* results. If, however, Core Frame Offset>0, the corresponding output data block of the first coder 11 is transferred by the number Core Frame Offset of output data blocks of first coder earlier. Put differently, the delay between the first output data block of the first coder after the LATM header and the first AAC frame results from CoreCoderDelay (FIG. 1)+Core Frame Offset×Core block length (block length of coder 1 in FIG. 2*b*). As can be seen from the comparison of FIG. 2*c* and 2*d,* for Core Frame Offset=zero (FIG. 2*c*), the output data blocks 11 and 12 of the first coder after the LATM header 200 are transferred. By transferring Core Frame Offset=2, the output data blocks 13 and 14 can follow the LATM header 200, whereby the delay in a pure CELP decoding, that is decoding of the first scaling layer, can be decreased by two CELP block lengths. With this example, an offset of three blocks would be the optimum. An offset of one or two blocks, however, also results in a delay advantage.

By this bit stream setup, it is possible according to the invention that the CELP coder can transfer the produced CELP block immediately after coding. In this case, no additional delay is added to the CELP coder by the bit stream multiplexer (20). Thus, for this case, no additional delay is added to the CELP delay by the scalable combination so that the delay becomes minimal.

It is to be pointed out that the case shown in FIG. 2*d* is only an example. Thus different ratios of the block length of the first coder and the block length of the second coder are possible, which can, for example, vary from 1:2 to 1:12 or can also take different ratios, wherein, according to the invention, ratios smaller than one can be improved regarding the delay.

In an extreme case (for MPEG 4 CELP/AAC 1:12), this means that the CELP coder produces twelve output data blocks for the same time interval of the input signal for which the AAC coder produces an output data block. The delay advantage by the inventive data stream shown in FIG. 2*d* compared to the data stream shown in FIG. 2*c* can, in this case, reach an order of magnitude of a fourth of a second to half a second. This advantage will be the more, the greater the ratio between the block length of the second coder and the block length of the first coder will be, wherein in the case of the AAC coder as the second coder, the largest possible block length is aimed at due to the ratio between payload information to side information, which is more favorable in this case if the signal to be coded makes this possible.

Figure 3:
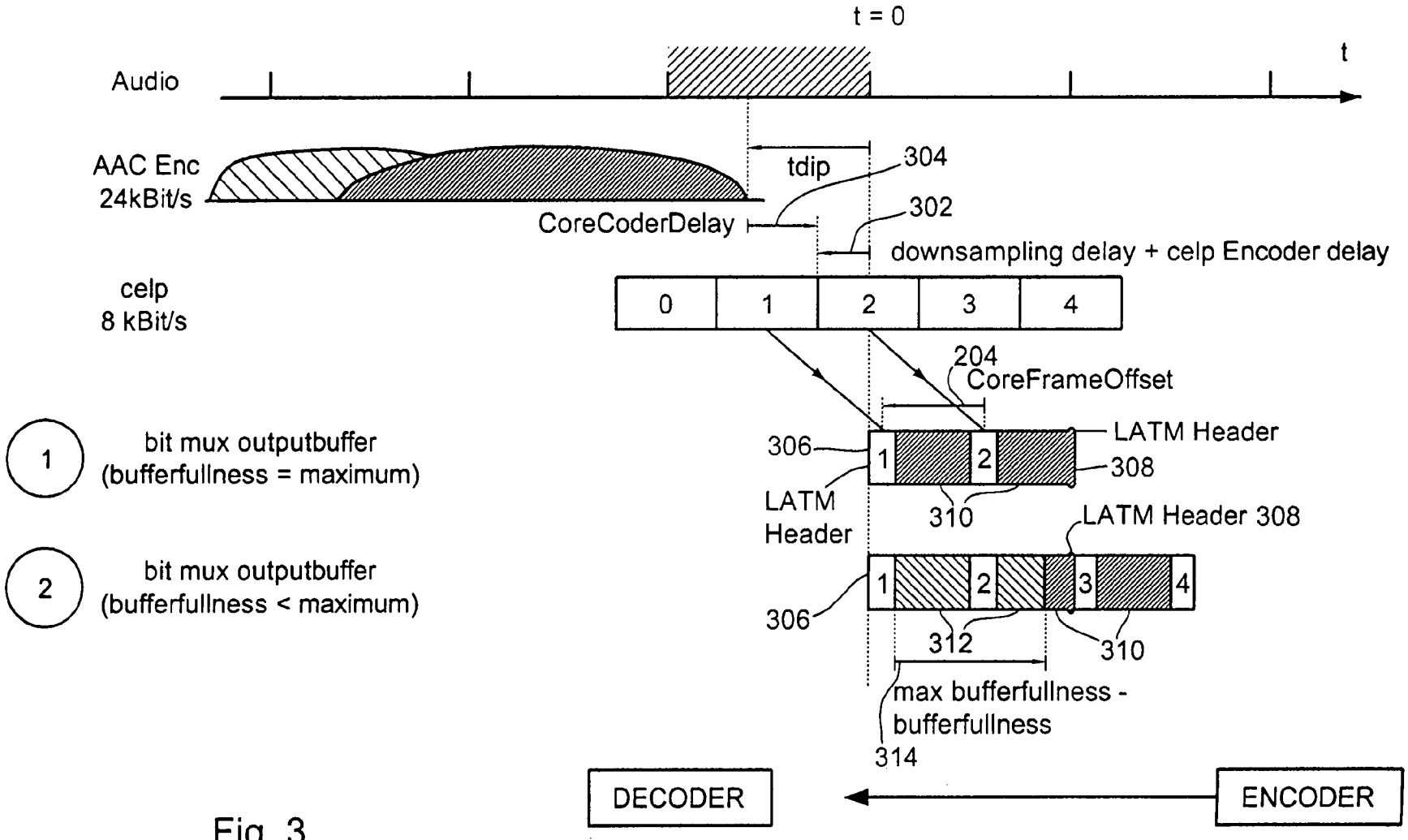
FIG. 3 is a detailed illustration of the inventive scalable data stream with the example of a CELP coder as the first coder and an AAC coder as the second coder with and without a bit savings bank function.
Figure 4:
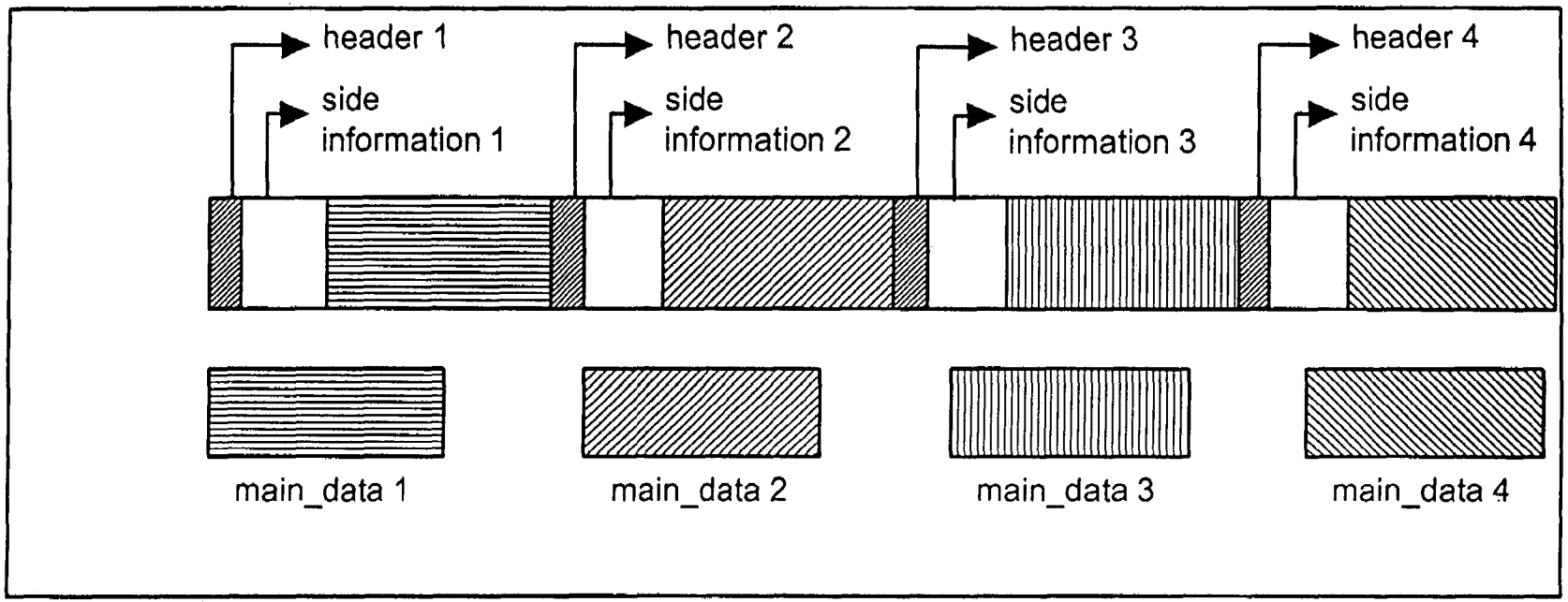
FIG. 4 is an example of a bit stream format having a fixed frame length.

In the following reference is made to FIG. 3, which is similar to FIG. 2, which, however, illustrates the special implementation with the example of MPEG 4. In the first line a current time interval is again illustrated in a hatched manner. In the second line the windowing used in the AAC coder is illustrated schematically. As is already known, an overlap and add of 50% is used so that a window usually has double the length of time sample values compared to the current time interval illustrated in the uppermost line of FIG. 3 in a hatched manner. In FIG. 3 the delay tdip is also indicated which corresponds to block 26 of FIG. 1 and, in the selected example, has a size of ⅝ the block length. Typically a block length of the current time interval of 960 sample values is employed so that the delay tdip of ⅝ the block length is 600 sample values. As an example, the AAC coder provides a bit stream of 24 kBit/s while the CELP coder schematically illustrated below it provides a bit stream having a rate of 8 kBit/s, which results in an overall bit rate of 32 kBit/s.

As can be seen from FIG. 3, the output data blocks zero and one of the CELP coder corresponds to the current time interval of the first coder. The output data block with number 2 of the CELP coder already corresponds to the next time interval for the first coder. The same applies to the CELP block with number 3. In FIG. 3 the delay of the down-sampling stage 28 and the CELP coder 12 is indicated by an arrow designated by the reference number 302. As the delay, which has to be set by stage 34, in order for equal conditions to exist at the subtraction place 40 of FIG. 1, the delay indicated by CoreCoderDelay and illustrated in FIG. 3 by an arrow 304 results from this. This delay can alternatively also be produced by block 226. Thus, for example, the following applies:

$$\text{CoreCoderDelay} == tdip - \text{CoreEncoderDelay} - \text{Downsampling Delay} = 600 - 120 - 117 = 363 \text{ sample values.}$$

For the case without a bit savings bank function or for the case that the bit savings bank (Bit Mux Outputbuffer) is full, which is indicated by the variable Bufferfullness=Max, the case shown in FIG. 2*d* results. Unlike FIG. 2*d* in which four output data blocks of the first coder are produced corresponding to an output data block of the second coder, in FIG. 3 two output data blocks of the CELP coder, referred to with "0" and "1" are produced for an output data block of the second coder which is illustrated in black color in the two bottom most lines of FIG. 3. According to the invention, however, it is no longer the output data block of the CELP coder with number "0" that is written after a first LATM header 306 but the output data block of the CELP coder with number "one" since the output data block with number "zero" has already been transferred to the decoder. CELP block 2 for the next time interval follows CELP block 1 in the equidistant scan interval provided for the CELP data blocks, wherein for completing a frame the rest of the data of the output data block of the AAC coder is written into the data stream until a next LATM header 308 for the next time interval follows.

The present invention can, as is illustrated in the last line of FIG. 3, easily be combined with the bit savings bank function. For the case that the variable "Bufferfullness" indicating the fullness of the bit savings bank is smaller than the maximum value, this means that the AAC frame has required more bits than actually allowed for the directly previous time interval. This means that the CELP frames, like before, are written after the LATM header 306, but that at first the output data block or the output data blocks of the AAC coder from directly previous time intervals have to be written into the bit stream before writing the output data block of the AAC coder for the current time interval can be started. From the comparison of the two last lines from FIG. 3, which are illustrated by "1" and "2", it can be seen that the bit savings bank function directly leads to a delay in the coder for the AAC frame. Thus data for the AAC frame of the current time interval referred to by 310 in FIG. 3 is present at the same time as in case "1", can, however, only be written into the bit stream after the AAC data 312 for the directly previous time interval has been written into the bit stream. Depending on the bit savings bank situation of the AAC coder, the starting position of the AAC frame shifts.

The bit savings bank situation is transferred according to MPEG 4 in the element StreamMuxConfig by the variable "Bufferfullness". The variable Bufferfullness can be calculated from the variable Bitreservoir divided by 32 times the currently present channel number of audio channels.

Figure 5:
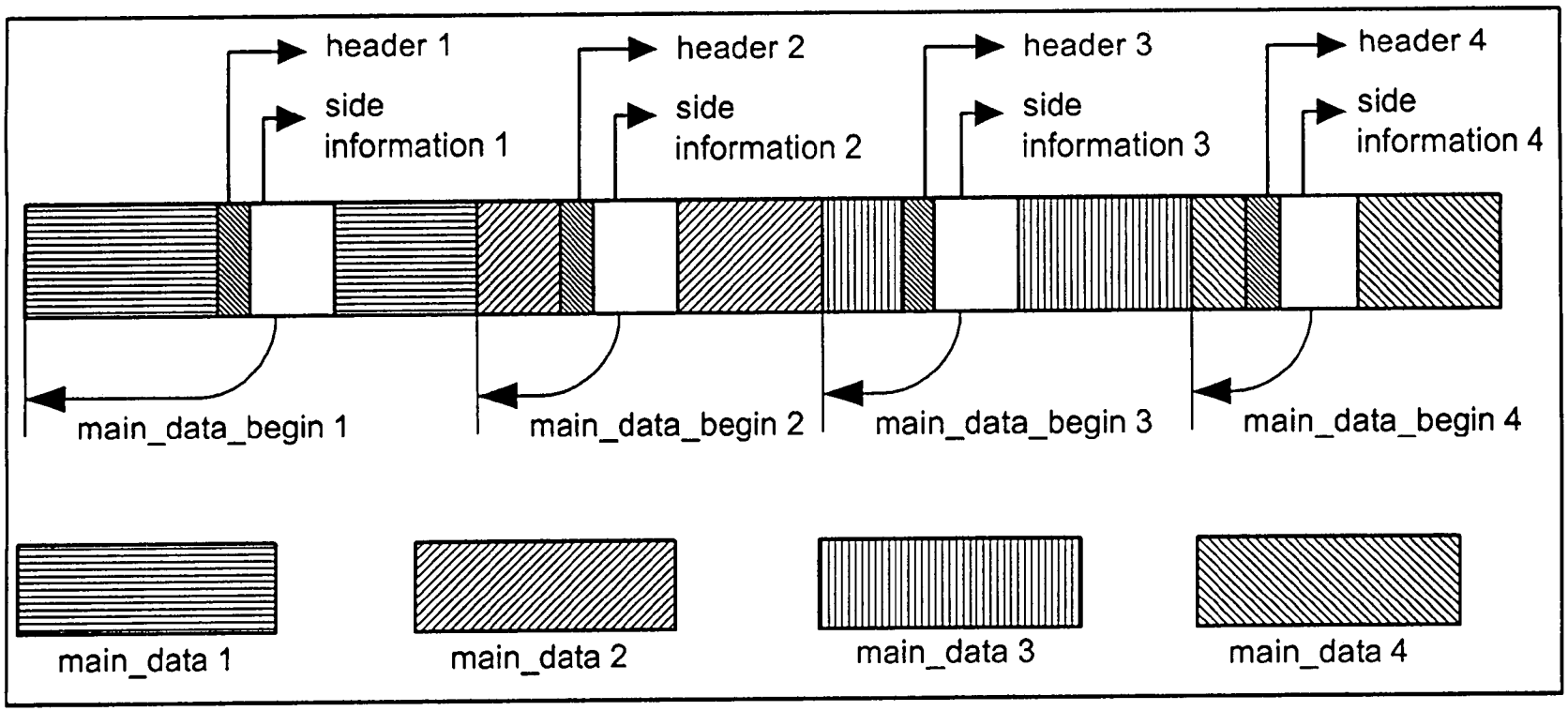
FIG. 5 is an example of a bit stream format having a fixed frame length and a back pointer.
Figure 6:
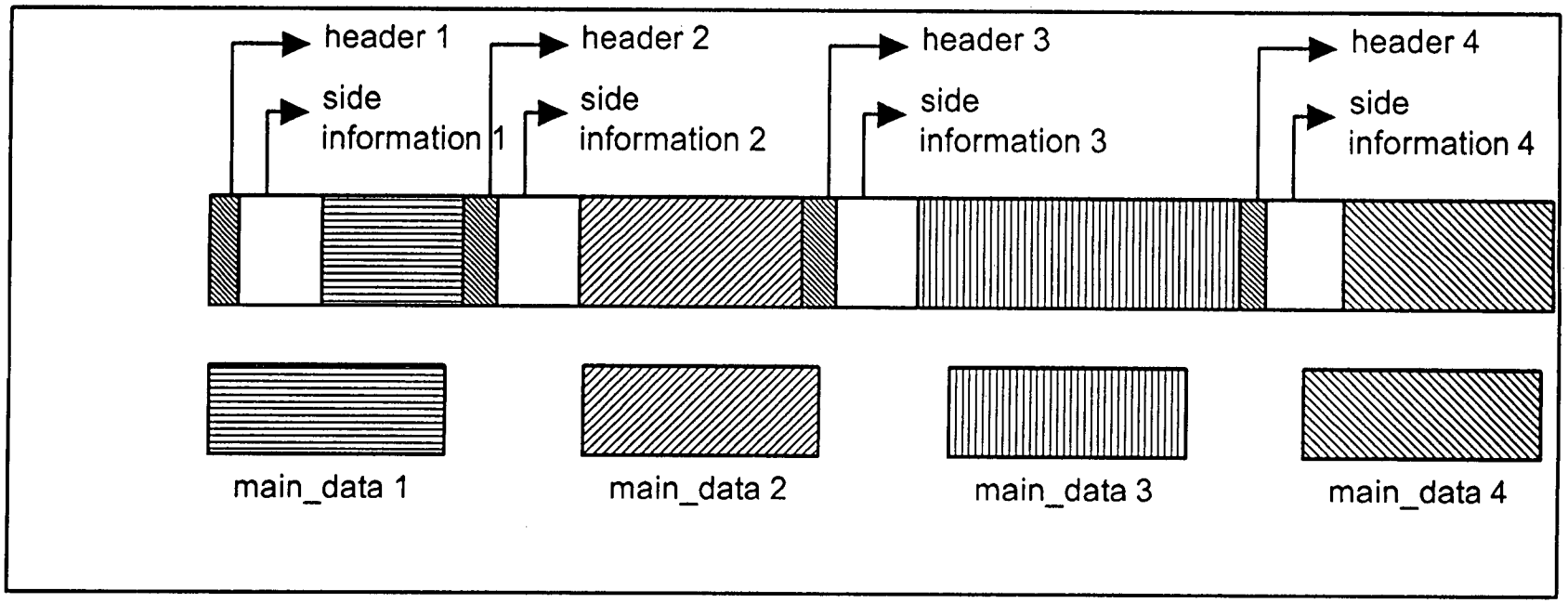
FIG. 6 is an example of a bit stream format having a variable frame length.

It is to be pointed out that the pointer labeled with the reference number 314 in FIG. 3, the length of which=max Bufferfullness−Bufferfullness, is a forward pointer which, in a certain sense, points to the future, while the pointer shown in FIG. 5 is a backward pointer which, in a certain sense, point to the past. This is due to the fact that, according to the present embodiment, the LATM header is always written into the bit stream after the current time interval has been processed by the AAC coder although, if necessary, AAC data from previous time intervals may still have to be written into the bit stream.

It is further pointed out that the pointer 314 is deliberately illustrated in a broken line below CELP block 2 since it does not take account of the length of CELP block 2 or the length of CELP block 1 since this data of course has nothing to do with the bit savings bank of the AAC coder. In addition, header data or bits of further layers which may be present are not taken into consideration either.

In the decoder, an extraction of the CELP frames from the bit stream is performed at first, which can be done easily since they are, for example, arranged in an equidistant way and have a fixed length.

In the LATM header, however, length and distance of all the CELP blocks may be signaled anyway so that a direct decoding is possible in any case.

Thus the parts of the output data of the AAC coder of the directly previous time interval, which have somehow been separated by CELP block 2, are joined again and the LATM header 306 in a certain sense moves to the beginning of the pointer 314 so that the decoder, knowing the length of the pointer 314, knows when the data of the directly previous time interval ends in order to be able to decode the directly previous time interval together with the CELP data blocks present for it with full audio quality when this data is completely read in.

In contrast to the case shown in FIG. 2*c* in which both the output data blocks of the first coder and the output data block of the second coder follow an LATM header, on the one hand, a shift of output data blocks of the first coder in the forward direction in the bit stream can take place by the variable Core Frame Offset, while by the arrow 314 (max Bufferfullness−Bufferfullness) a shift of the output data block of the second coder in the backward direction in the scalable data stream can be obtained so that the bit savings bank function can be implemented in the scalable data stream in a simple and save way, while the basic raster of the bit stream is maintained by the subsequent LATM determination data blocks which are written whenever the AAC coder has coded a time interval and which can thus serve as a reference point even when, as is illustrated in the last line in FIG. 3, a large part of the data in the frame referenced by an LATM header on the one hand comes from the next time interval (regarding the CELP Frames) or comes from the previous time interval (regarding the AAC Frames), wherein the respective shifts can, however, be communicated to a decoder by the two variables in the bit stream which are to be transferred additionally.

What is claimed is:

1. A method of producing a scalable data stream of at least two blocks of output data of a first coder -and at least one block of output data of a second coder, comprising:

writing a header for a current section of an input signal for the first coder or the second coder;

writing a block of output data of the second coder, in the direction of transfer from a coding device to a decoding device, after the header;

writing at least one block of output data of the first coder, in the direction of transfer, in front of the header; and writing offset information into the scalable data stream, indicating that the at least one block of output data of the first coder, in the direction of transfer, is in front of the header.

2. The method according to claim 1, wherein the blocks of output data of the first coder are written into the scalable data stream in such a way that they are arranged in equidistant intervals, or wherein the blocks of output data of the first coder have the same length.

3. The method according to claim 1, wherein the block of output data of the second coder for equally long sections of the input signal has different lengths, wherein a block of output data of the first coder for the current section of the input signal for the first coder is written directly after the header, wherein at least a part of a block of output data of the second coder for a previous section of the input signal is arranged after the block of output data of the first coder, and wherein buffer information is written into the scalable data stream, indicating how long the output data of the second coder for the previous section of the input signal for the second coder extends after the header.

4. The method according to claim 3, wherein the second coder comprises a bit savings bank function, wherein a size of the bit savings bank function is given by a maximum buffer size information, and wherein a current situation of the bit savings bank function is given by a current buffer information, and wherein the buffer information corresponds to the current buffer information so that a decoder can determine by subtracting the current buffer information from the maximum buffer information and by exclusively considering output data of the second coder where in the scalable data stream after the header in the current section the block of output data of the second coder for the current section begins.

5. The method according to claim 1, wherein writing the at least one block of output data of the first coder for the current section is directly performed when the at least one block is output by the first coder, wherein writing the header for the current section is only performed when the block of output data of the second coder for the current section is output by the second coder, and wherein writing the output data of the second coder is only performed when, if necessary, existing output data of the second coder for a previous section of the input signal is written into the scalable data stream when the header for the current section is written and when there is presently no block of output data of the first coder for writing.

6. The method according to claim 1, wherein more than one block of output data of the first coder for the current section of the input data is written in front of the header, and wherein the offset information indicates how many blocks of output data of the first coder for the current section of the input signal are arranged in front of the header for the current section of the input signal.

7. The method according to claim 1, wherein the at least one block of output data of the second coder and the at least two blocks of output data of the first coder are a payload data in a superframe, wherein a ratio of the number of blocks of output data of the second coder and the number of blocks of output data of the first coder is smaller than one and, in particular, is one of the following ratios: 2/3, 1/2, 1/3, 1/4, 1/6, 1/12, 3/4.

8. A method of decoding a scalable data stream of at least two blocks of output data of a first coder and at least one block of output data of a second coder, wherein the scalable data stream comprises a header for the current section of the first coder or the second coder, a block of output data of the second coder after the header, at least one block of output data of the first coder in front of the header and offset information indicating that the at least one block of output data of the first coder, in the direction of transfer from a coding device to a decoding device, is in front of the header, the method comprising:

reading the at least one block of output data of the first coder;

reading the output data of the second coder;

reading the offset information;

determining that the at least one block of output data of the first coder belongs to the output data of the second coder although the at least one block is in front of the header in the data stream; and decoding the output data of the second coder and the output data of the first coder to obtain a decoded signal.

9. A device for producing a scalable data stream of at least two blocks of output data of a first coder and at least one block of output data of a second coder, the device comprising:

a data stream writer formed to:

write a header for the current section of the input signal for the first or the second coder;

write a block of output data of the second coder, in the direction of transfer from a coding device to a decoding device, after the header;

write at least one block of output data of the first coder, in the direction of transfer, in front of the header; and write offset information in the scalable data stream indicating that the at least one block of output data of the first coder, in the direction of transfer, is in front of the header.

10. A device for decoding a scalable data stream of at least two blocks of output data of a first coder and at least one block of output data of a second coder, wherein the scalable data stream comprises a header for the current section of the first coder or the second coder, a block of output data of the second coder after the header, at least one block of output data of the first coder in front of the header and offset information indicating that the at least one block of output data of the first coder, in the direction of transfer from a coding device to a decoding device, is in front of the header, the device comprising:

a data stream demultiplexer formed to:

read the at least one block of output data of the first coder;

read the output data of the second coder;

read the offset information;

determine that the at least one block of output data of the first coder belongs to the output data of the second coder although the at least one block is in front of the header in the data stream; and a decoder for decoding the output data of the second coder and the output data of the first coder to obtain a decoded signal.

11. The method according to claim 1, wherein the at least two blocks of output data of the first coder together represent a number of sample values of the input signal for the first coder which form a current section of the input signal for the first coder, and wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is the same, and wherein the current sections for the first and the second coder are identical or shifted compared to each other by a duration.

12. The method according to claim 8, wherein the at least two blocks of output data of the first coder together represent a number of sample values of the input signal for the first coder forming a current section of the input signal for the first coder, wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is equal, and wherein the current sections for the first and second coders are identical or shifted regarding each other by a duration.

13. The device according to claim 9, wherein the at least two blocks of output data of the first coder together represent a number of sample values of the input signal for the first coder forming a current section of the input signal for the first coder, wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is equal, and wherein the current sections for the first and second coders are identical or shifted regarding each other by a duration.

14. The device according to claim 10, wherein the at least two blocks of output data of the first coder together represent a number of sample values of the input signal for the first coder forming a current section of the input signal for the first coder, wherein the at least one block of output data of the second coder represents a number of sample values of the input signal for the second coder, wherein the number of sample values for the second coder forms a current section of the input signal for the second coder, wherein the number of sample values for the first coder and the number of sample values for the second coder is equal, wherein the current sections for the first and second coders are identical or shifted, regarding each other, by a duration.

* * * * *